US009056741B2

(12) United States Patent
Kang et al.

(10) Patent No.: US 9,056,741 B2
(45) Date of Patent: Jun. 16, 2015

(54) SHEET-LIKE MEDIUM STACKING APPARATUS

(71) Applicant: GRG Banking Equipment Co., Ltd., Guangzhou, Guangdong (CN)

(72) Inventors: Jianxin Kang, Guangzhou (CN); Hongjun Wu, Guangzhou (CN); Zhongwu Lai, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 14/353,567

(22) PCT Filed: Apr. 1, 2013

(86) PCT No.: PCT/CN2013/073553

§ 371 (c)(1),
(2) Date: Apr. 23, 2014

(87) PCT Pub. No.: WO2014/000487

PCT Pub. Date: Jan. 3, 2014

(65) Prior Publication Data

US 2014/0265107 A1 Sep. 18, 2014

(30) Foreign Application Priority Data

Jun. 26, 2012 (CN) ..... 2012 1 0214243

(51) Int. Cl.
*B65H 31/26* (2006.01)
*B65H 13/00* (2006.01)
(Continued)

(52) U.S. Cl.
CPC ..... *B65H 13/00* (2013.01); *B65H 29/52* (2013.01); *B65H 29/68* (2013.01); *B65H 31/02* (2013.01);
(Continued)

(58) Field of Classification Search
CPC ..... B65H 29/001; B65H 31/26; B65H 31/36; B65H 2405/114; B65H 2405/115; B65H 2405/33; B65H 2408/13
USPC ..... 271/220, 207
See application file for complete search history.

(56) References Cited

U.S. PATENT DOCUMENTS 3,537,704 A * 11/1970 Bond ..... 271/177
7,686,296 B2 * 3/2010 Kaneko et al. ..... 271/220
(Continued)

FOREIGN PATENT DOCUMENTS

CN 101284610 A 10/2008
CN 101284611 A 10/2008
(Continued)

OTHER PUBLICATIONS

International Search Report dated Jul. 4, 2013 from corresponding International Application No. PCT/CN2013/073553.

*Primary Examiner* — Michael McCullough
(74) *Attorney, Agent, or Firm* — Wolf, Greenfield & Sacks, P.C.

(57) ABSTRACT

Disclosed is a sheet-like medium stacking apparatus provided for bearing and arranging sheet-like medium. The apparatus comprises: a bearing plate for receiving and bearing sheet-like medium delivered by the conveyance channel; a blocking mechanism facing an outlet at the end of the conveyance channel and used for preventing the sheet-like medium from continuing to move forward, the blocking mechanism comprising a storage part baffle plate in a lap joint with the bearing plate to form an accommodating chamber accommodating the sheet-like medium; and an arcuate section extending and curving towards the storage part baffle plate, is provided at the end of the bearing plate remote from the conveyance channel, the arcuate section overlapping the storage part baffle plate. The sheet-like medium stacking apparatus can effectively solve the problem of bills delivered at high speed becoming folded up or even blocking the outlet.

7 Claims, 7 Drawing Sheets

(51) Int. Cl.

| | |
|---|---|
| ***B65H 29/52*** | (2006.01) |
| ***B65H 29/68*** | (2006.01) |
| ***B65H 31/02*** | (2006.01) |
| ***G07D 11/00*** | (2006.01) |
| ***B65H 31/36*** | (2006.01) |

(52) U.S. Cl.

CPC ..... *B65H 31/26* (2013.01); *B65H 2404/1114* (2013.01); *B65H 2405/1114* (2013.01); *B65H 2405/11151* (2013.01); *B65H 2405/112* (2013.01); *B65H 2701/1912* (2013.01); *G07D 11/0018* (2013.01); *B65H 31/36* (2013.01); *B65H 2301/4212* (2013.01); *B65H 2405/1118* (2013.01); *B65H 2405/1124* (2013.01); *B65H 2407/20* (2013.01); *B65H 2601/325* (2013.01)

(56) References Cited

U.S. PATENT DOCUMENTS

| | | | | |
|---|---|---|---|---|
| 8,485,523 | B2 * | 7/2013 | Kimura et al. | 271/220 |
| 2002/0105136 | A1 * | 8/2002 | Ries | 271/207 |
| 2010/0096801 | A1 * | 4/2010 | Yanagida | 271/220 |
| 2012/0049441 | A1 * | 3/2012 | Kimura et al. | 271/177 |

FOREIGN PATENT DOCUMENTS

| | | | |
|---|---|---|---|
| CN | 101284612 | A | 10/2008 |
| CN | 102020135 | A | 4/2011 |
| CN | 102745536 | A | 10/2012 |
| JP | H 3205257 | | 9/1991 |
| JP | 2002211814 | A | 7/2002 |
| JP | 2006089197 | A | 4/2006 |

* cited by examiner

SHEET-LIKE MEDIUM STACKING APPARATUS

This application is the national phase of International Application No. PCT/CN2013/073553, filed on Apr. 1, 2013, which claims the benefit of priority to Chinese patent application No. 201210214243.6, titled "SHEET MEDIUM STACKING DEVICE" and filed with the Chinese State Intellectual Property Office on Jun. 26, 2012, which applications are hereby incorporated by reference to the maximum extent allowable by law.

FIELD OF THE INVENTION

The present application relates to a sheet medium processing device, in particular, to a device for stacking and arranging the sheet medium separated and conveyed one by one.

BACKGROUND OF THE INVENTION

At present, a device for stacking and arranging sheet mediums conveyed one by one is commonly used in the self-service financial apparatus. In the self-service financial apparatus, it requires that the sheet mediums, such as banknotes, are separated and conveyed one by one, and then are stacked and arranged after the old and new as well as true and false identification, or other detections in the conveying process, such that the banknotes are stored in the self-service apparatus or supplied to an operator for withdrawing the banknote.

In the existing self-service financial apparatus, the banknotes separated and conveyed one by one are supplied to the sheet medium stacking device by the conveying passage at a high speed. The existing sheet medium stacking device includes: a supporting plate for supporting the sheet medium, and a blocking mechanism corresponded to an outlet of the conveying passage for blocking the sheet medium from being moved forward. When the sheet medium is conveyed to the stacking device by the conveying passage at a high speeds, the sheet medium is directly collided with the blocking mechanism at a high speed due to the inertial motion. The sheet medium is rebounded in a direction opposite to its previous movement direction under the action of the blocking mechanism, thereby increasing the movement time of the sheet medium in the stacking device. Besides, the outlet of the conveying passage is blocked by the tail end of the sheet medium due to the rebound movement, the next sheet medium may be collided with the previous one when it is conveyed out, which results in some problems, for example, the sheet mediums are stacked in disorder, or even the outlet is plugged.

SUMMARY OF THE INVENTION

An object of the present application is to provide a sheet medium stacking device which can effectively solve the problem that banknotes supplied at a high speed are stacked in disorder or even causing the outlet being blocked, such that the sheet medium is stably decelerated and is stacked orderly.

The sheet medium stacking device is provided at a tail end of a sheet medium conveying passage for carrying and arranging the sheet medium, and includes: a carrying plate for receiving and carrying the sheet medium supplied through the conveying passage, and a blocking mechanism corresponded to an outlet at the tail end of the conveying passage for blocking the sheet medium from being moved forward. The blocking mechanism includes an accumulating portion blocking plate which is overlapped with the carrying plate to form a receiving chamber for receiving the sheet medium. An end of the carrying plate that is away from the conveying passage has an arc segment bent and extended towards the accumulating portion blocking plate, and the arc segment and the accumulating portion blocking plate are overlapped with each other.

Preferably, a curvature radius of the arc segment is larger than three quarters of a width of the narrowest sheet medium.

Preferably, at least the arc segment of the carrying plate has a surface which has a large friction coefficient.

Further, the blocking mechanism includes an elastic pressing sheet extended obliquely from the tail end of the conveying passage to the arc segment, for guiding the sheet medium supplied through the tail end of the conveying passage to the carrying plate, such that the sheet medium is stacked and arranged.

Preferably, an angle formed by the elastic pressing sheet and a sheet medium being conveyed out through the tail end of the conveying passage is ranged from 25 degree to 45 degree.

Further, a deformation force of the elastic pressing sheet meets the following condition: the maximum deformation resistance is:

$$F=mv^2/2S(\mu_1+\mu_2),$$

wherein, m is a mass of the sheet medium, v is a speed of the sheet medium while being conveyed out, S is a distance that the sheet medium is slid on the carrying plate, $\mu_1$ is a dynamic friction coefficient of the elastic pressing sheet, and $\mu_2$ is a dynamic friction coefficient of the carrying plate.

Preferably, a tail end of the elastic pressing sheet is close to a surface of the arc segment.

Preferably, the accumulating portion blocking plate includes two blocking strips which are elastically and pivotally connected to a mounting shaft, and a space is formed between the two blocking strips for allowing a person to take the sheet medium stacked therein.

Compared with the existing art, the valuable document identification device has some advantages, for example:

in the technical solutions according to the present application, an end of the carrying plate away from the conveying passage has an arc segment bent and extended towards the accumulating portion blocking plate, and the arc segment and the accumulating portion blocking plate are overlapped with each other, therefore the sheet medium is slid forward along the arc segment of the carrying plate, until it is collided with the accumulating portion blocking plate. In the process, the speed of the sheet medium is greatly reduced because of the arc segment, and the direction thereof is changed from an obliquely downward direction to an obliquely upward direction. When the sheet medium is collided with the accumulating portion blocking plate, the sheet medium is stopped quickly because of an elastic buffering mechanism of the accumulating portion blocking plate. Thereby the sheet medium is stacked and arranged.

In addition, the elastic pressing sheet provided at the tail end of the conveying passage and extended obliquely to the arc segment functions to guide the sheet medium quickly such that the sheet medium is in contact with the carrying plate and supply the sheet medium with a pressure such that it is pressed towards the carrying plate, therefore, the sheet medium can be decelerated rapidly on the carrying plate to minimize the rebound movement of the sheet medium, thereby ensuring the regularity of the stacking of the sheet medium.

DETAILED DESCRIPTION

For further illustrating the present application, a preferred embodiment of the present application will be introduced hereinafter in conjunction with the drawings.

Figure 1:
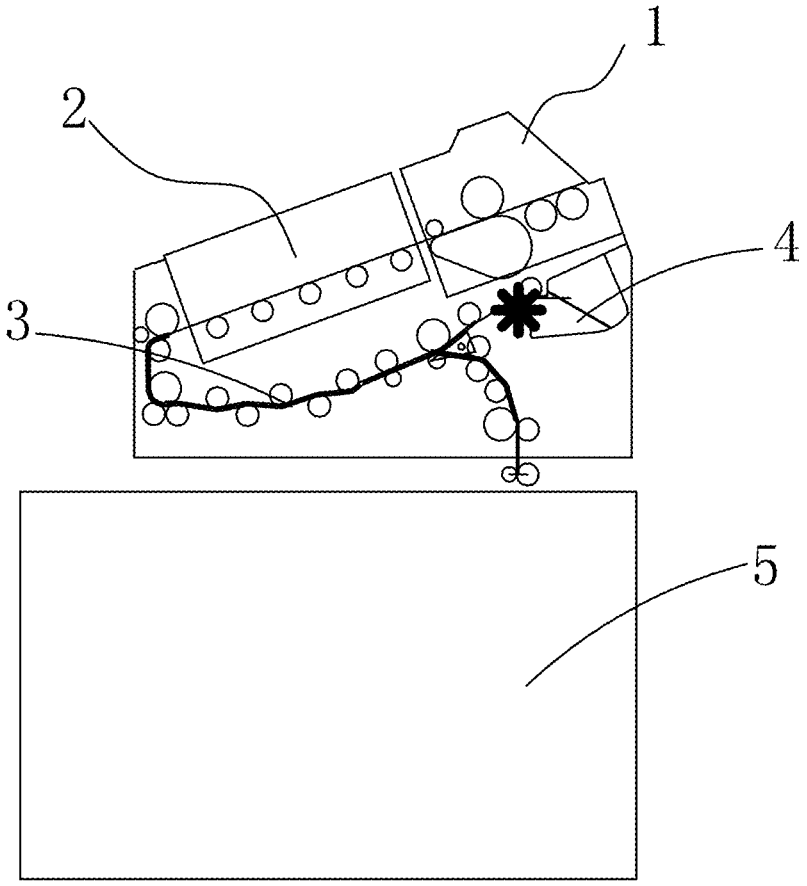
FIG. 1 is a schematic view showing a using state of a sheet medium stacking device according to the present application.

Referring to FIG. 1, FIG. 1 is a schematic view showing a using state of a sheet medium stacking device according to the present application. The sheet medium is used in a self-service financial apparatus which includes: a sheet medium separating component 1 for separating the deposited entire stack of banknotes one by one, a sheet medium detecting component 2 for detecting banknotes passed one by one, a sheet medium conveying passage 3 for conveying the banknote one by one, a sheet medium storage device 5 for storing the deposited banknotes, and a sheet medium stacking device 4 for stacking and arranging the banknotes conveyed out one by one. Banknotes are separated by the sheet medium separating component 1 one by one and are conveyed to the sheet medium detecting component 2. And banknotes that are identified as acceptable banknotes are conveyed to the sheet medium storage device 5 through the sheet medium conveying passage 3, while banknotes that are identified as unacceptable banknotes are conveyed to the sheet medium stacking device 4 through the sheet medium conveying passage 3.

Figure 2:
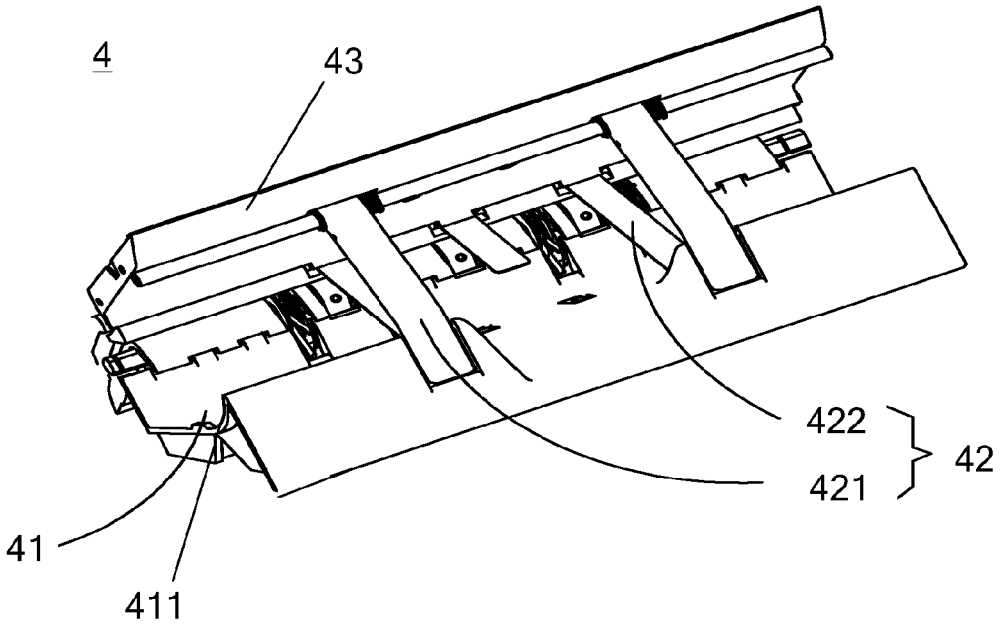
FIG. 2 is a structural schematic view of the sheet medium stacking device according to the present application.
Figure 3:
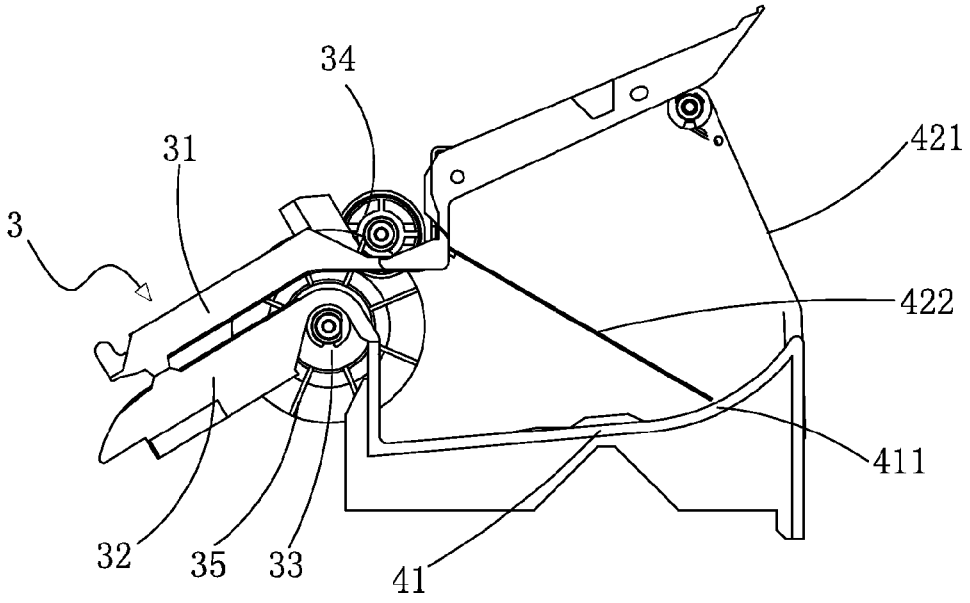
FIG. 3 is a side structural schematic view of the sheet medium stacking device according to the present application.
Figure 4:
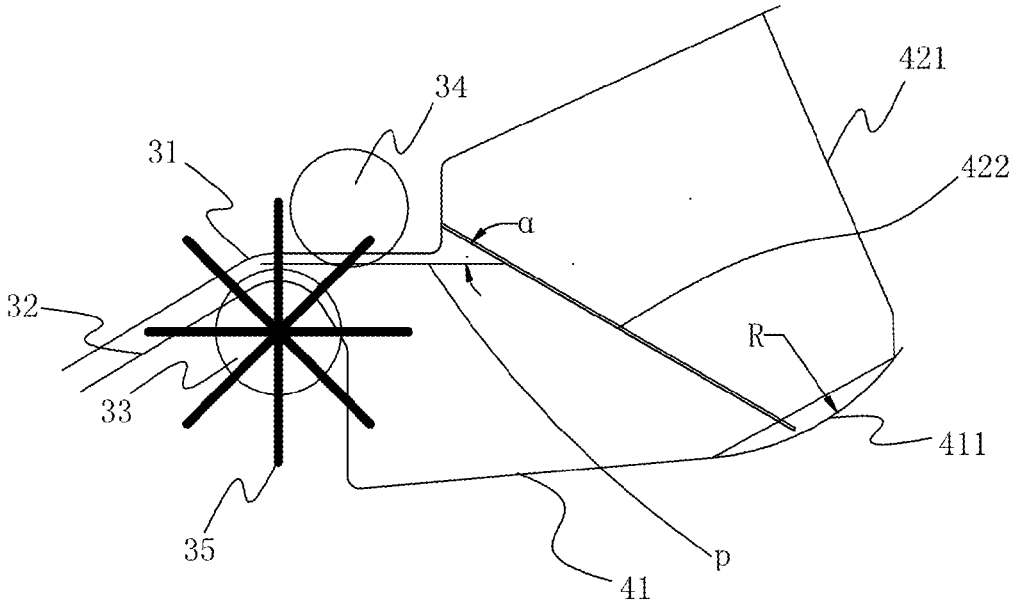
FIG. 4 is a schematic view showing a stacking principle of the sheet medium stacking device according to the present application.

The sheet medium stacking device 4 according to the present application will be further described by referring to FIGS. 2 to 4. The sheet medium stacking device 4 is arranged at a tail end of the sheet medium conveying passage 3 for carrying and arranging the sheet medium (banknote in this embodiment). The sheet medium stacking device 4 includes: a carrying plate 41 for receiving and carrying the sheet medium supplied through the conveying passage 3, and a blocking mechanism 42 corresponded to an outlet at the tail end of the conveying passage 3 for blocking the sheet medium from being moved forward. The blocking mechanism 42 includes an accumulating portion blocking plate 421 which is overlapped with the carrying plate 41 to form a receiving chamber for receiving the sheet medium. The accumulating portion blocking plate 421 includes two blocking strips which are elastically and pivotally connected to a mounting shaft. A space is formed between the two blocking strips, allowing a person to take the sheet medium stacked therein. The mounting shaft is fixed to a lower surface of a top plate 43 which is provided opposite to the carrying plate 41, that is, a surface opposite to the carrying plate. The accumulating portion blocking plate 421 is elastically and pivotally connected to the mounting shaft via a torsion spring. The end of the carrying plate 41 that is away from the conveying passage 3 has an arc segment 411 bent and extended towards the accumulating portion blocking plate 421. The arc segment 411 and the accumulating portion blocking plate 421 are overlapped with each other. The curvature radius R of the arc segment 411 is larger than three quarters of a width of the narrowest sheet medium. The blocking mechanism 42 further includes an elastic pressing sheet 422 (three elastic pressing sheets are provided in this embodiment) extended obliquely from the tail end of the conveying passage 3 to the arc segment 411, for guiding the sheet medium supplied from the tail end of the conveying passage 3 to the carrying plate, such that the sheet medium are stacked and arranged. The elastic pressing sheet 422 is made from plastic, rubber or sheet metal materials deformable under an external force. The angle $\alpha$ formed by the elastic pressing sheet and the sheet medium being conveyed out through the tail end of the conveying passage 3 is ranged from 25 degree to 45 degree. In the present embodiment, the mounting angle is 35 degree. The tail end of the elastic pressing sheet is close to the surface of the arc segment, that is, the tail end of the elastic pressing sheet should be within an enclosed region formed by an arc length and a chord length of the arc slope of the accumulating portion lower plate. The maximum deformation resistance of the elastic pressing sheet meets the following relationship:

$$F=mv^2/2S(\mu_1+\mu_2);$$

Wherein m is a mass of the sheet medium, v is a speed of the sheet medium when being conveyed out, S is a distance that the sheet medium is slid on the carrying plate, $\mu_1$ is a dynamic friction coefficient of the elastic pressing sheet, and $\mu_2$ is a dynamic friction coefficient of the carrying plate.

Figure 5:
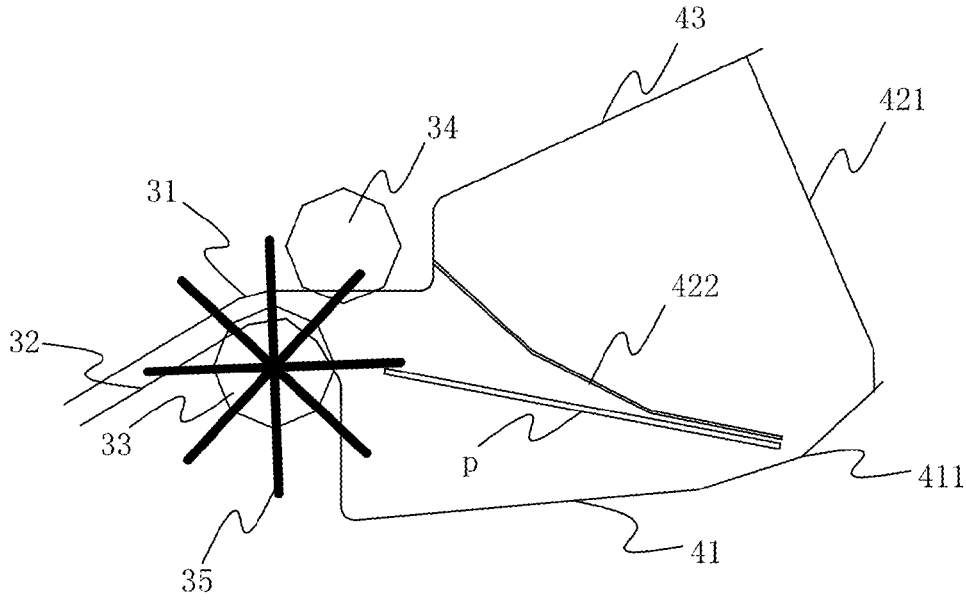
FIG. 5 is a schematic view of the sheet medium stacking device according to the present application when stacking a sheet medium having a large stiffness.
Figure 6:
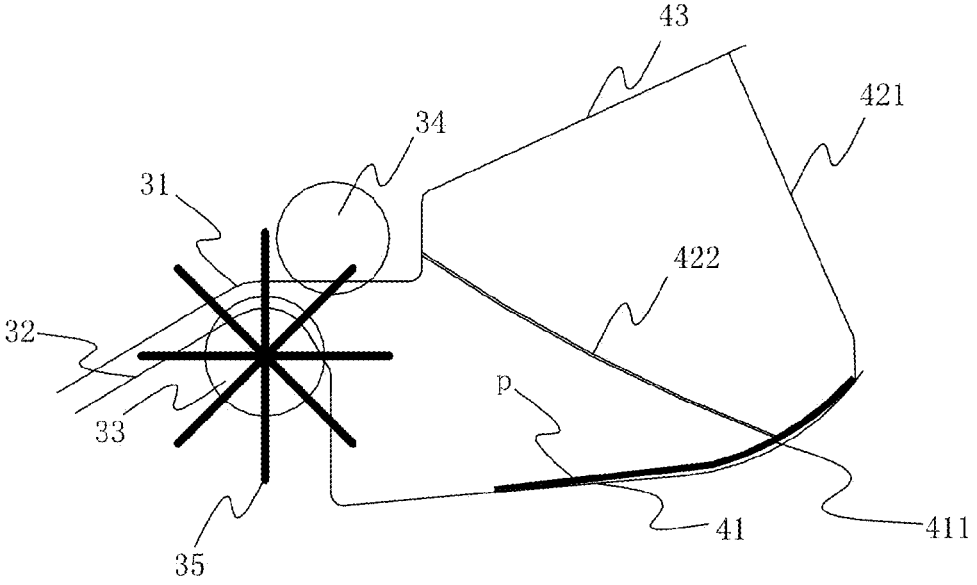
FIG. 6 is a schematic view of the sheet medium stacking device according to the present application in a state that the stacking is completed.

Referring to FIG. 4 and FIG. 5, the conveying passage 3 includes an upper passage plate 31, a lower passage plate 32, an active conveying wheel 33 located at the tail end of the conveying passage for providing power to the sheet medium, a driven conveying wheel 34, and an impeller 35 coaxial with the active conveying wheel 33. When the sheet medium p is conveyed to the sheet medium stacking device 4 via the conveying passage 3, and after the tail end of the sheet medium p is moved away from the conveying wheels 33 and 34, the sheet medium p is moved forward along the direction of the elastic pressing sheet 422 because of inertia, meanwhile the sheet medium p exerts a force on the elastic pressing sheet 422, causing the elastic pressing sheet 422 being deformed, as shown in FIG. 5. After the sheet medium p is in contact with the carrying plate 41, the sheet medium p is slid forward along the arc slope of the arc segment 411 of the carrying plate 41, until it is collided with the accumulating portion blocking plate 421, as shown in FIG. 6. In this process, the elastic pressing sheet 422 exerts a counter force on the sheet medium p because of plastic deformation, such that the sheet medium p is in contact with the carrying plate 41 as early as possible. The speed of the sheet medium p is decreased gradually due to the frictional resistance when it is sliding on the carrying plate 41. Meanwhile, since the front end of the sheet medium p is raised gradually, the whole sheet medium p is pressed on the carrying plate 41 by the elastic pressing sheet 422 at a larger force, thereby increasing the frictional resistance. When the sheet medium p is collided with the accumulating portion blocking plate 421, the speed of the sheet medium p is greatly reduced and the direction thereof is changed from an obliquely downward direction to an obliquely upward direction. The accumulating portion blocking plate 421 exerts an obliquely downward counter force F on the sheet medium under the impact from the sheet medium, while the impact force applied to the accumulating portion blocking plate 421 is weakened because of a buffer structure (the torsion spring). The sheet medium p is moved obliquely and downwards under the counter force applied by the accumulating portion blocking plate 421, and is finally stopped on the accumulating portion lower plate 41 under the frictional resistance of the carrying plate 41 and the pressure of the elastic pressing sheet 422. Alternatively, in order that the accumulating portion blocking plate 421 has a better buffering performance, the accumulating portion blocking plate 421 may be made from materials having buffering performances, or a layer of material having a buffering performance may be coated onto the surface of the accumulating portion blocking plate 421 to be in contact with the sheet medium. Further, in order to effectively reduce the speed of the sheet medium and to effectively prevent the stacked sheet medium from falling under its own gravity, the arc segment 411 of the carrying plate 41 has a surface with larger friction coefficient, for example, by increasing the roughness of the surface.

Hereinafter, a process of stacking the medium by the stacking device according to the present application is illustrated by referring to FIGS. 4 to 10. The sheet medium p is conveyed to the sheet medium stacking device 4 through the conveying passage 3. After the tail end of the sheet medium p is moved away from the conveying wheels 33 and 34, the sheet medium p is moved forward along the direction of the elastic pressing sheet 422 under the inertia. The tail end of the sheet medium is flapped by the impeller 35 such that it is in contact with the carrying plate 41 as soon as possible. Meanwhile, the elastic pressing sheet 422 is deformed under a force exerted by the sheet medium p.

Figure 7:
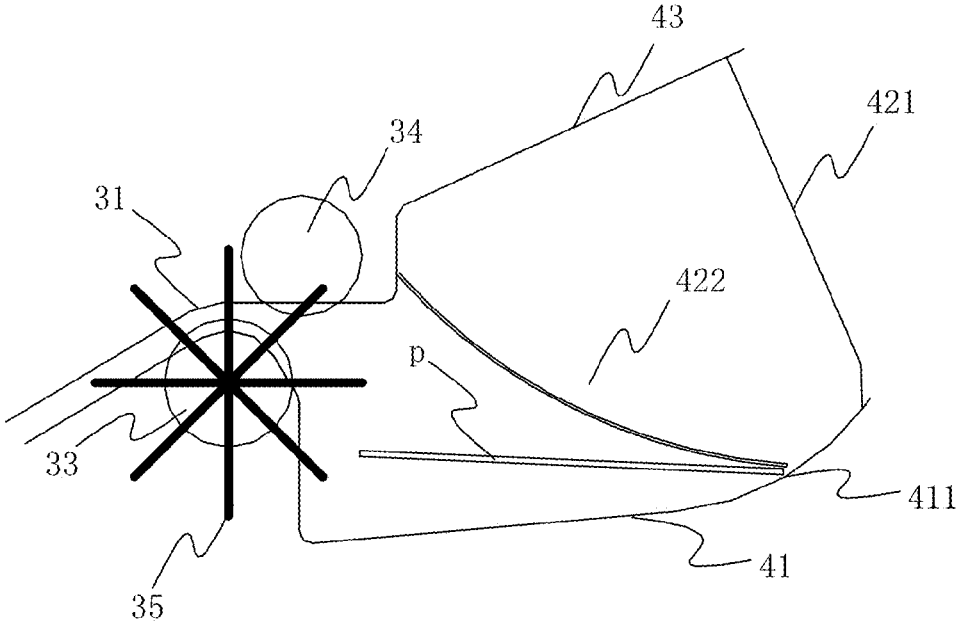
FIG. 7 is a schematic view of the sheet medium stacking device according to the present application showing a process of stacking a medium having a large stiffness.
Figure 8:
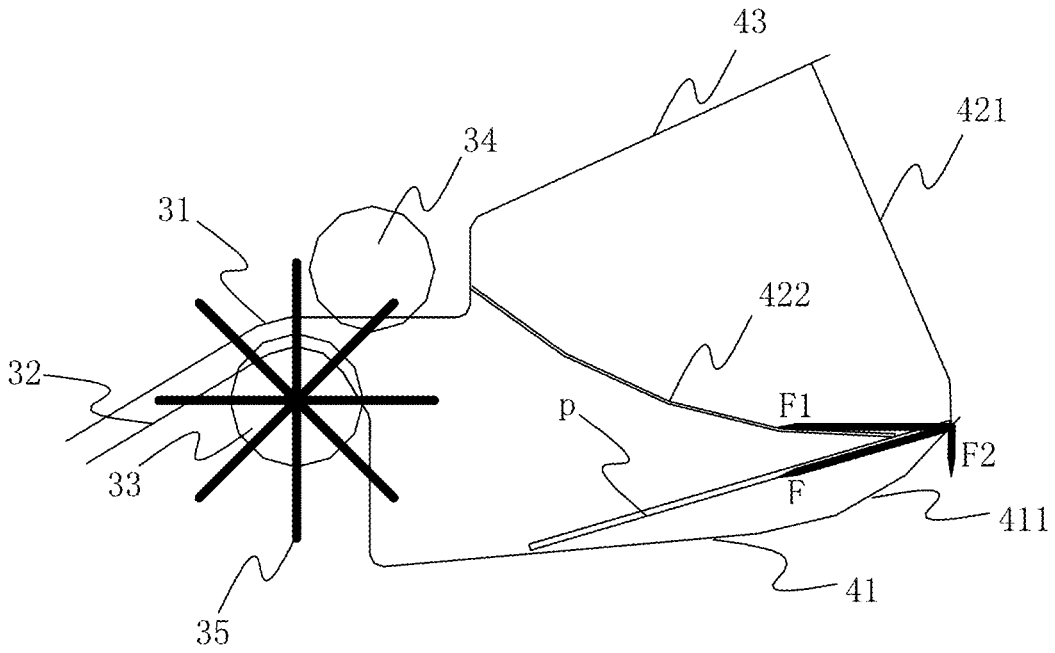
FIG. 8 is a schematic view of the sheet medium stacking device according to the present application showing a process of stacking a medium having a large stiffness.

As shown in FIG. 7, in a case that the sheet medium p has a larger stiffness, when it is conveyed to the sheet medium stacking device 4, since the sheet medium p itself is deformed slightly while the elastic pressing sheet 422 is deformed largely, a larger pressure is exerted on the sheet medium p such that the sheet medium is in contact with the carrying plate 41 soon and is slid thereon. Meanwhile, the front end of the sheet medium p is raised gradually along the arc slope of the arc segment 411 of the carrying plate 41 during the sliding process of the sheet medium p, and the movement direction of the sheet medium p is changed from the obliquely downward direction when the sheet medium p becomes in contact with the carrying plate 41 to the obliquely upward direction. When the front end of the sheet medium p is collided with the accumulating portion blocking plate 421, the direction of the counter force exerted on the sheet medium is obliquely downward, as shown in FIG. 8. At this time, the sheet medium p is subject to the pressure of the elastic pressing sheet 422 and the counter force F of the accumulating portion blocking plate 421, and when the frictional resistance exerted on the sheet medium p by the carrying plate, which frictional resistance is obtained by the resultant force of the pressure and a vertical component F2 of the counter force F of the accumulating portion blocking plate 421, is larger than the horizontal component F1 of the counter force F, the sheet medium is stopped on the carrying plate 41.

Figure 9:
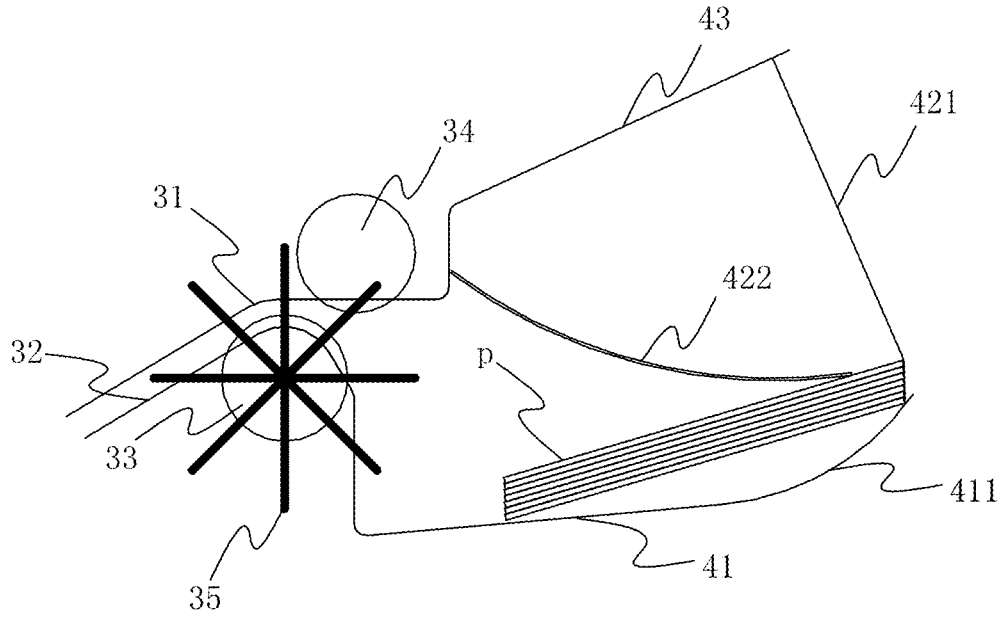
FIG. 9 is a schematic view of the sheet medium stacking device according to the present application showing a state in which the stacking of the medium having a large stiffness is completed.

As shown in FIG. 9, in the process that the sheet medium is moved continuously, since a slope formed by the previous sheet medium is steeper than the arc slope of the carrying plate 41, the pressure, exerted by the elastic pressing sheet 422, on the sheet medium subsequently supplied is increased gradually, while the counter force F exerted by the accumulating portion blocking plate 421 is decreased gradually, and the horizontal component F1 of the counter force exerted on the sheet medium is decreased gradually. Therefore the sheet medium is easily stopped at the tail end of the carrying plate 41.

Figure 10:
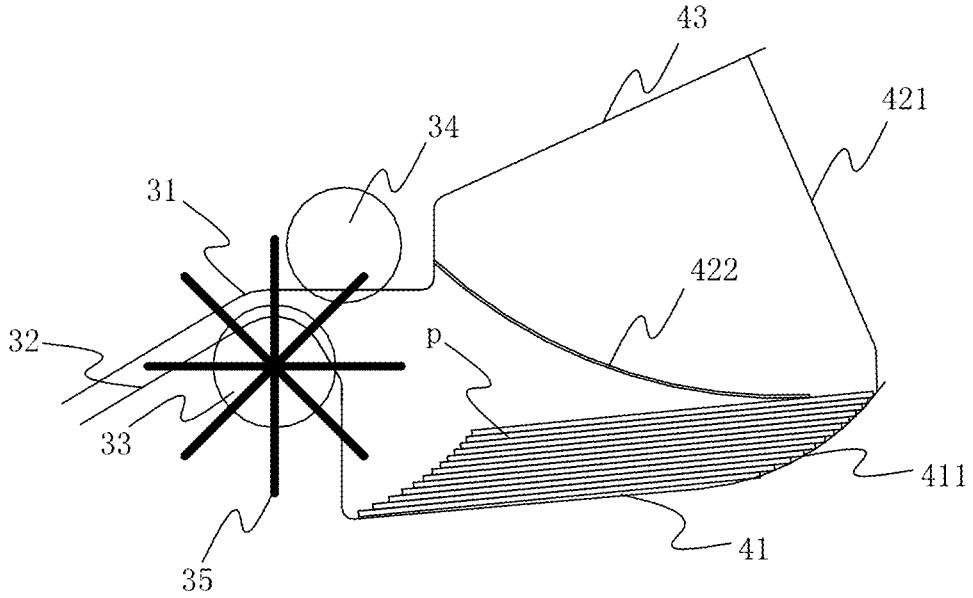
FIG. 10 is a stacking schematic view of the sheet medium stacking device according to the present application when stacking a medium having a large stiffness and a relatively smooth surface.

As shown in FIG. 10, in a case that the sheet medium has a large stiffness and a relatively smooth surface (such as a sheet medium made from the plastic material), after a sheet medium is stopped at the tail end of the carrying plate 41, and in the process that sheet mediums are continuously conveyed out, when a sheet medium subsequently conveyed out is stacked on carrying plate 41, the front end thereof is relatively slid with respect to the arc slope of the arc segment of the carrying plate 41 since the pressure exerted by the elastic pressing sheet 422 is increased, therefore the resistance exerted on the sheet medium subsequently conveyed out is increased. Therefore, the force acted on the accumulating portion blocking plate 421 by the sheet medium when it is collided with the accumulating portion blocking plate and the counter force of the accumulating portion blocking plate 421 are reduced. Finally the sheet medium is stopped at the tail end of the carrying plate 41. In this case, if the surface of the arc slope of the arc segment of the carrying plate 41 is relatively smooth, it has the same effect as that in which the sheet medium has a larger stiffness and a relatively smooth surface.

Figure 11:
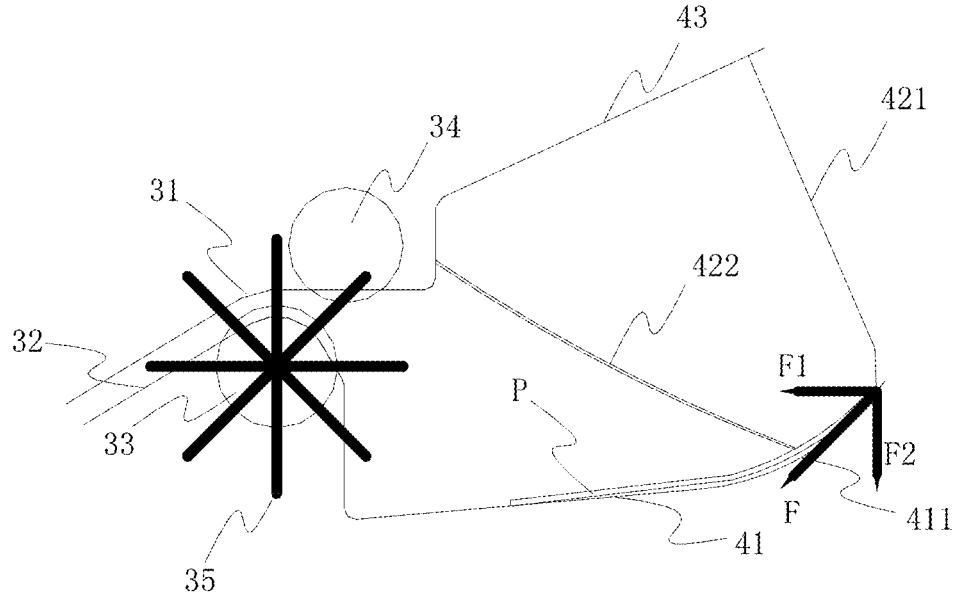
FIG. 11 is a schematic view of the sheet medium stacking device according to the present application when stacking a medium having a small stiffness, and the medium is in a conveyed out state.

As shown in FIG. 11, in a case that the sheet medium has a small stiffness, when it is conveyed to the sheet medium stacking device 4, the deformation of the elastic pressing sheet 422 is small since the sheet medium is prone to be deformed, and the front end of the sheet medium is relatively close to the carrying plate 41. Therefore the sheet medium is moved along the direction of the elastic pressing sheet 422 and becomes in contact with the carrying plate 41 earlier. Meanwhile the sheet medium is slid on the carrying plate 41 at a larger distance, which thereby largely reduces the speed of the sheet medium. Since the stiffness of the sheet medium is small, it is easier for the sheet medium to slide forward close to the arc slope of the carrying plate 41. When the sheet medium is collided with the accumulating portion blocking plate 421, an impact angle smaller than that when the stiffness of the sheet medium is large is obtained. At this time, the horizontal component F1 of the counter force F acted on the sheet medium by the accumulating portion blocking plate 421 becomes smaller, while the vertical component F2 becomes larger. Thereby it is easier for the sheet medium to be stopped at the tail end of the carrying plate 41. In the process that sheet mediums are conveyed out continuously, since the previous sheet is abutted on the arc slope of the carrying plate 41, which is equivalent to the case that the arc slope of the carrying plate 41 is thicken and heighten, the pressure applied by the elastic pressing sheet 422 to the sheet medium subsequently conveyed out is increased gradually, while the counter force of the accumulating portion blocking plate 421 is decreased gradually, and thus the horizontal component of the counter force exerted on the sheet medium is decreased gradually, and it is easier for the sheet medium to be stopped at the tail end of the carrying plate 41.

Figure 12:
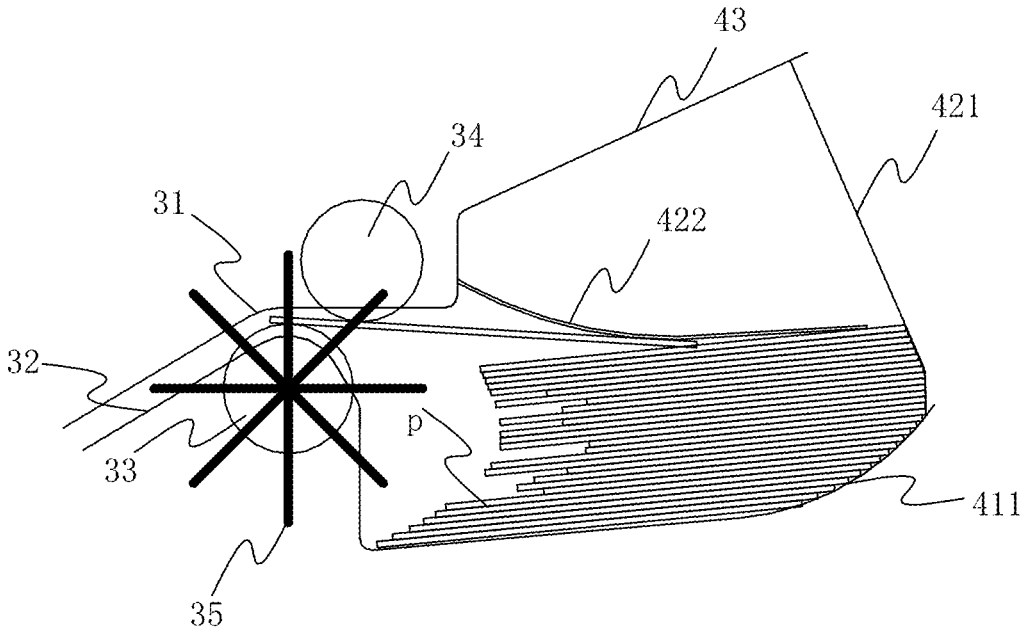
FIG. 12 is a schematic view of the sheet medium stacking device according to the present application when stacking mediums having various sizes, and the mediums are in a conveyed out state.

In a case that the sheet mediums conveyed out have different sizes, the movements thereof are similar to that in the above mentioned process, and the stacked effect is as shown in FIG. 12.

The above embodiments are only preferred embodiments of the present application. It should be noted that, the above embodiments should not be considered as a limitation to the present application, and the protection scope of the present application should be defined by the claims. Various improvements and amendments may be made by those skilled in the art without departing from the spirit and scope of the present application, and these improvements and amendments should also be deemed to fall into the protection scope of the present application.

The invention claimed is:

1. A sheet medium stacking device which is provided at a tail end of a sheet medium conveying passage for carrying and arranging the sheet medium, the sheet medium stacking device comprising:

a carrying plate for receiving and carrying the sheet medium supplied through the conveying passage; and a blocking mechanism corresponded to an outlet at the tail end of the conveying passage for blocking the sheet medium from being moved forward, the blocking mechanism comprising an accumulating portion blocking plate which is overlapped with the carrying plate to form a receiving chamber for receiving the sheet medium;

wherein an end of the carrying plate that is away from the conveying passage has a concave arc segment bent and extended towards the accumulating portion blocking plate, and the concave arc segment and the accumulating portion blocking plate are overlapped with each other at a higher end of the concave arc segment; and the blocking mechanism further comprises an elastic pressing sheet extended obliquely from the tail end of the conveying passage to the concave arc segment, for guiding the sheet medium supplied through the tail end of the conveying passage to the carrying plate, such that the sheet medium is stacked and arranged.

2. The sheet medium stacking device according to claim 1, wherein a curvature radius of the concave arc segment is larger than three quarters of a width of the narrowest sheet medium.

3. The sheet medium stacking device according to claim 1, wherein at least the concave arc segment of the carrying plate has a surface which has a friction coefficient such that a speed of the sheet medium is reduced and a stacked sheet medium is prevented from falling down to a horizontal end of the carrying plate under a gravity of the stacked sheet medium.

4. The sheet medium stacking device according to claim 1, wherein a tail end of the elastic pressing sheet is close to a surface of the concave arc segment.

5. The sheet medium stacking device according to claim 1, wherein an angle formed by the elastic pressing sheet and a sheet medium being conveyed out through the tail end of the conveying passage is ranged from 25 degree to 45 degree.

6. The sheet medium stacking device according to claim 1, wherein a deformation force of the elastic pressing sheet meets the following condition: the maximum deformation resistance is:

$$F=mv^2/(2S(\mu_1+\mu_2));$$

wherein, m is a mass of the sheet medium, v is a speed of the sheet medium while being conveyed out, S is a distance that the sheet medium is slid on the carrying plate, $\mu_1$ is a dynamic friction coefficient of the elastic pressing sheet, and $\mu_2$ is a dynamic friction coefficient of the carrying plate.

7. The sheet medium stacking device according to claim 1, wherein the accumulating portion blocking plate comprises two blocking strips which are elastically and pivotally connected to a mounting shaft, and a space is formed between the two blocking strips for allowing a person to take the sheet medium stacked therein.

* * * * *